United States Patent [19]

D'Amico

[11] Patent Number: 4,865,330

[45] Date of Patent: Sep. 12, 1989

[54] SOCCER KICK-TRAINING DEVICE

[76] Inventor: Nick D'Amico, 24555 Copper Cliff, El Toro, Calif. 92630

[21] Appl. No.: 250,767

[22] Filed: Sep. 28, 1988

[51] Int. Cl.[4] ..... A63B 69/00

[52] U.S. Cl. ..... 273/411; 273/55 B

[58] Field of Search ..... 273/411, 55 B

[56] References Cited

U.S. PATENT DOCUMENTS

| | | | |
|---|---|---|---|
| 2,239,200 | 4/1941 | Peterson | 273/55 B |
| 2,659,604 | 11/1953 | McGowen | 273/55 B |
| 3,481,602 | 12/1969 | Tatter | 273/55 B |
| 4,418,910 | 12/1983 | Stenerud | 273/55 B |
| 4,516,769 | 5/1985 | Kopp | 273/411 X |
| 4,537,397 | 8/1985 | Kopp | 273/55 B |
| 4,616,834 | 10/1986 | Davis | 273/411 |

*Primary Examiner*—William H. Grieb

*Attorney, Agent, or Firm*—Price, Gess & Ubell

[57] ABSTRACT

A soccer ball kick-training device holds the soccer ball at a variety of heights and placement positions to the pivot foot. The kick-trainer device is structured to guide the kicking foot into optimum contact with the ball. The kick-trainer is an assembly of relatively flat, lightweight parts that fit together. In a knockdown state it can be sold in a relatively flat, compact package. Assembled, it is still lightweight and easily carried.

11 Claims, 2 Drawing Sheets

FIG. 1
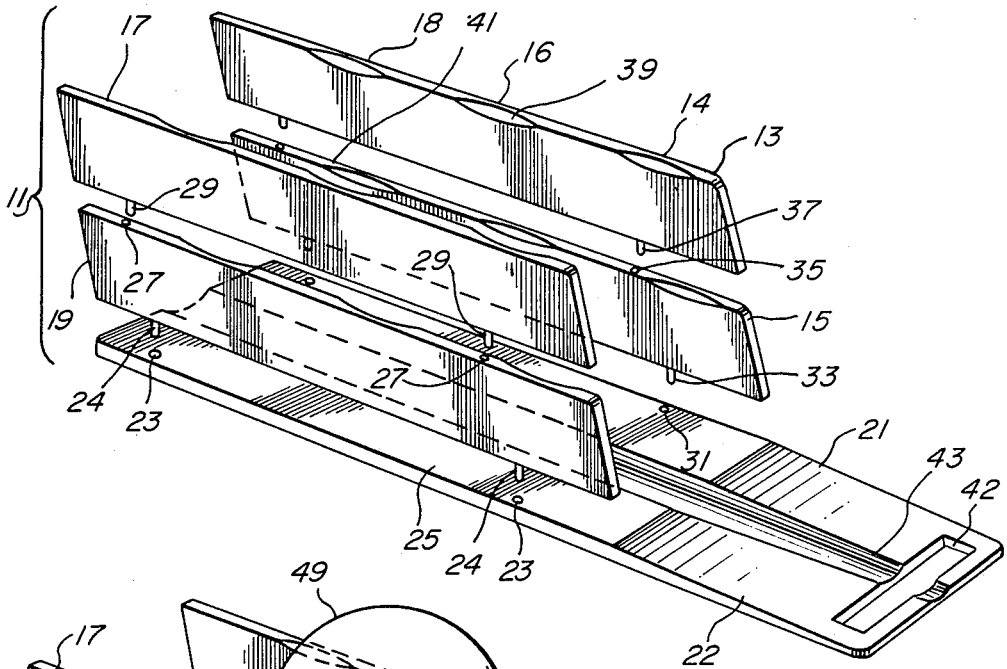
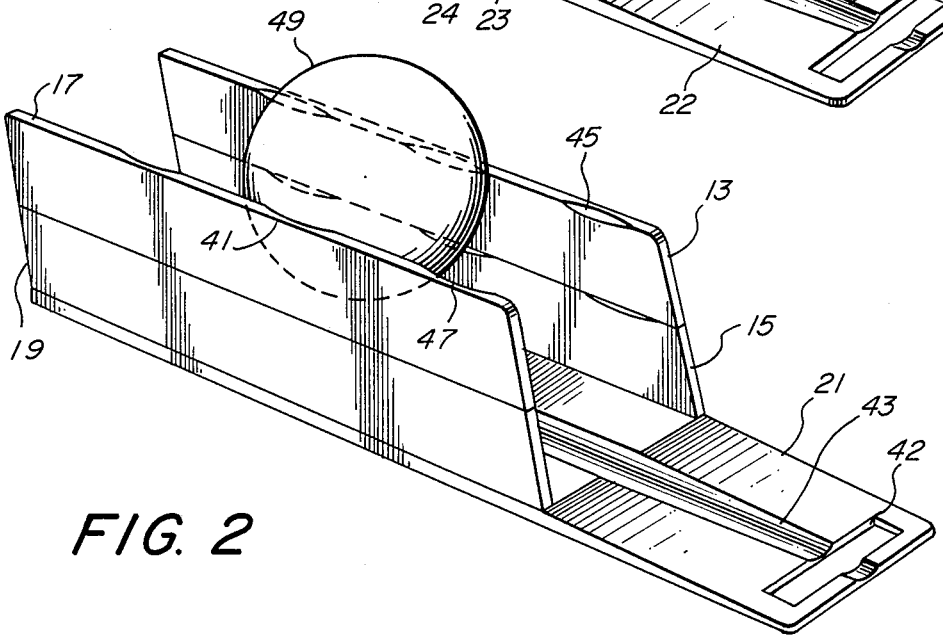
FIG. 2

SOCCER KICK-TRAINING DEVICE

BACKGROUND OF THE INVENTION

1. Field of the Invention

The present invention relates generally to improvements in athletic training devices and, more particularly, pertains to new and improved ball-kicking training devices for such sports as soccer.

2. Description of the Prior Art

In the field of athletic sports involving the use of various balls of various shapes, it has been the practice to employ a variety of ball-holding devices for the purpose of allowing an athlete to perform repeated physical maneuvers with respect to the ball for training purposes. When the ball of concern is a football, generally a variety of football-holding devices known as "kicking tees" are utilized. Examples of such prior art kicking tees can be found in U.S. Pat. Nos. 2,659,604, 3,481,602, 4,418,910 and 4,537,937. When the ball of concern is a round ball which is to be kicked such as, for example, a soccer ball, the prior art has devised mechanisms such as found in U.S. Pat. Nos. 4,516,769 and 4,616,834. None of these devices are specifically directed to the concept of providing a training mechanism which can be adjusted as the skill of the athlete improves with practice, as is the object of the present invention.

SUMMARY OF THE INVENTION

A modular soccer ball kick-training device is provided which permits ball placement at a variety of heights and positions with respect to the pivot foot, and guides the kicking foot into optimum contact with the ball. The modular components are made of a lightweight, preferably plastic material. The components fit together by a dowel pin arrangement. Once assembled, the entire unit can be easily carried by the built-in handle.

BRIEF DESCRIPTION OF THE DRAWINGS

The general objects and many of the attendant advantages of this invention will be readily appreciated as the same becomes better understood by reference to the following detailed description when considered in conjunction with the accompanying drawings, in which like reference numerals designate like parts throughout the FIGS. thereof, and wherein:

FIG. 1 is an exploded perspective of the soccer kick-training device of the present invention;

FIG. 2 is a perspective of the soccer kick-training device of the present invention with the ball in place;

DETAILED DESCRIPTION OF THE PREFERRED EMBODIMENTS

Figure 3:
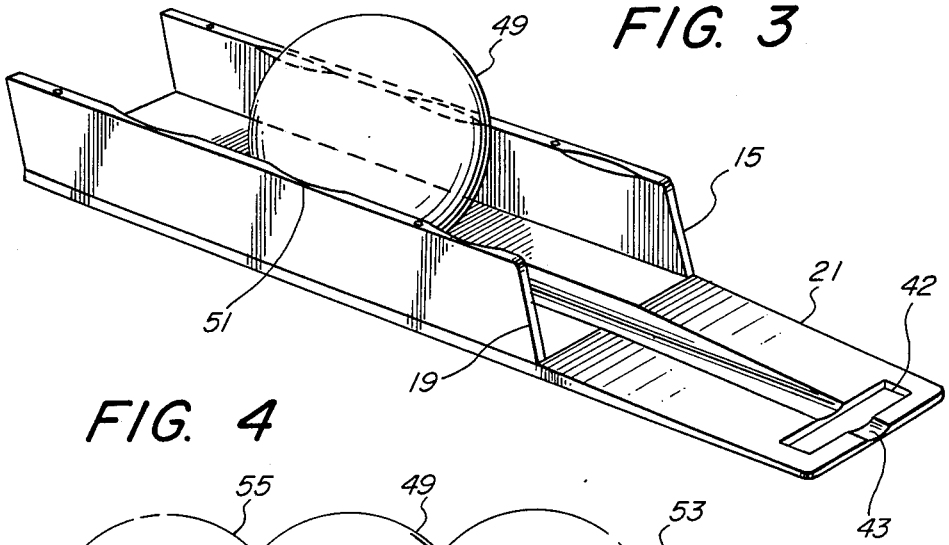
FIG. 3 is a perspective of a soccer kick-training device set up for advanced training purposes.

A preferred embodiment of the soccer kick-training apparatus according to the present invention is illustrated in the exploded perspective of FIG. 1. The soccer kick-trainer 11 is shown as consisting of four individual modular pieces comprising a base plate 21 and four similarly-shaped side support members 19, 15, 17 and 13. The side support members 13 and 17 fit on top and into the bottom side support members 15 and 19. The bottom side support members 15 and 19, in turn, fit into and are supported by the base plate 21. It is preferred that each piece of the soccer kick-trainer 11 be constructed of plastic by well-known plastic molding techniques, in order to keep the weight of the individual pieces light without sacrificing strength and impact resistance.

The base plate 21 is essentially a flat member of a preferred length with predetermined width and thickness. The length preferred is from 24 to 36 inches. The width should be slightly less than the diameter of a soccer ball or other ball 49 that is to be kicked. The thickness of the plate 21 will vary, depending upon the type of connection means utilized for holding the side support members to the base plate. For the dowel-type connection mechanism illustrated in FIG. 1, the preferred thickness is approximately 1 inch.

Although the base plate 21 is essentially flat, it does have a ramp portion 22 at the front end, which ramps up from the tip to the 1-inch height just before the side support members 19 and 15. These members are located on the flat part 24 of the base plate 21.

The base plate 21 has, in addition, a carrying hole 42 located at the front end, which is approximately 4 inches long and ¾ of an inch wide. A guiding groove 43 extends from the ramp along the upper surface of the plate at its center line to the other end. This groove 43 acts as a guide to the foot of the pupil trying to kick the ball. One preferred embodiment of the invention has the side support members 19, 15, 17 and 13, sixteen inches long.

The side support members 19, 15, 17 and 13 fit together by means of dowels such as 24 on side wall 19, dowels 33 on side wall 15, dowels 37 on side wall 13, and dowels 29 on side wall 17. These dowels fit into dowel apertures 23, 31, 35 and 27, respectively. Thus, side support member 19 fits into the apertures 23 of base plate 21, side support member 15 fits into the apertures 31 of base plate 21, side support member 17 fits on top of and into the apertures 27 of side support member 19, and side support member 13 fits on top of and into the apertures 35 of side support member 15, in effect making a double-height side support wall of a width which is slightly less than the diameter of the ball 49 to be placed between the two side support walls.

Each of the four sets of side support members has three ball placement locations 14, 16 and 18. Each ball placement location is defined by a pair of arced cutouts 39 and 41 in the top inside edges of the side support members, such as in side support members 13 and 7. These arced cutouts are on the same radius as the ball 49 to be utilized, which, according to the preferred embodiment, is a soccer ball. The placement of the ball 49 between two arced cutouts 39 and 41, for example, locates the ball 49 in the center of the two side support members 17 and 13 at the top height. Because of these two arced cutouts 41 and 39, the ball 49 is held gently in place and prevented from rolling along the length of the support members 17 and 13.

The top height illustrated in FIG. 2, which is obtained by the use of all four support members, one stacked on top of the other, is utilized for beginners. After the acquisition of some skill in kicking the ball, an advanced height is graduated to. The advanced height is lower, as illustrated in FIG. 3. The advanced height is obtained by removing the top two side support members 13 and 17 and placing the ball 49 on the inside edges having arcuate cutouts 51. This places the ball in a lower position, while still keeping it slightly above ground level, thereby simulating more closely the actual kicking position of the ball on a playing field.

Figure 4:
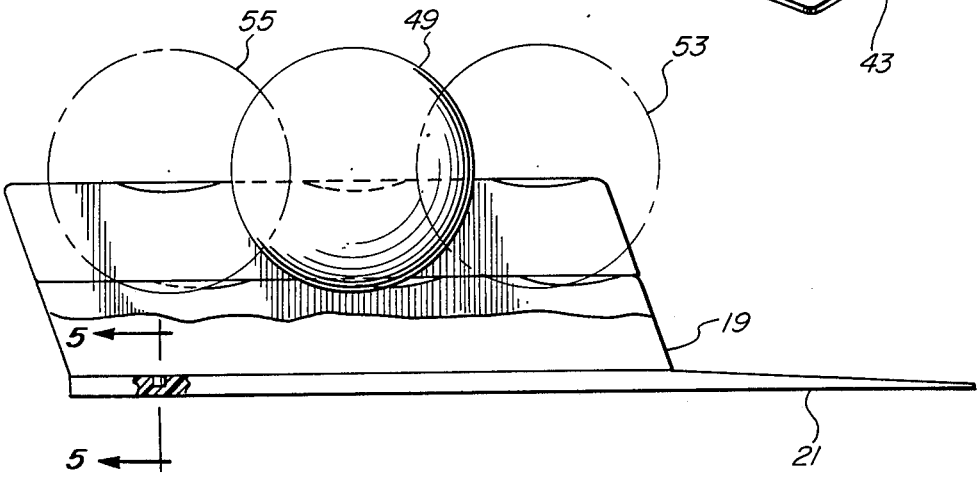
FIG. 4 is a side elevation partially broken away to show the ball placement positions of the device.

FIG. 4 illustrates that the ball may be placed at six different positions according to the preferred embodiment illustrated. Three positions are at the beginner training level, when both sets of side support members are utilized. Three additional positions are at the advanced training level, when only two sets of side support members are utilized. The six positions are obtained by moving the ball 49 from the middle position 49 to the close-in position 53 and the further-out position 55, at the two separate levels.

Figure 5:
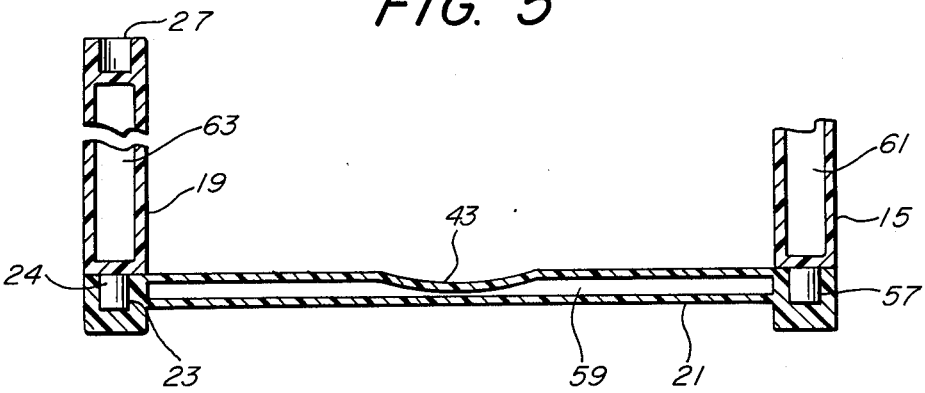
FIG. 5 is a cross-sectional view taken along the cross-section line in FIG. 4.

As was hereinabove described, it is preferred that the structure of the soccer kick-training device be made out of plastic because of the desirability for a lightweight, high-strength, impact-resistant structure. FIG. 5 illustrates a structure that is both lightweight and strong in that the side support members and the base plate have a double wall construction. The side support members have empty spaces 61 and 63 between the double walls. Base plate 21 also has an empty space 59 between its double walls. FIG. 5 also illustrates more clearly the dowels 24 and 57 that fit within apertures 23 of the base plate. The dowels 24 and 57 for each piece are an integral part of side support members 19 and 15, respectively. They fit within the apertures 23 of base plate 21. Side support members 19 and 15, for example, also have apertures 27 in their upper edge for the reception of the dowels of another pair of side support members.

The above-described soccer kick-training device will help younger aspiring soccer players achieve considerable success in using the "top of the foot" kick, also called a "shoelace kick" or an "instep kick." This type of kick is the predominant control kick utilized in the game of soccer. It is universally preferred by the coaches over the "toe poke" kick, which is the one naturally chosen by beginning players.

Training begins with the soccer ball 49 being placed in the uppermost height in the position closest to the ramp end of the kick-training device position 14. The aspiring soccer player stands on one foot right next to the ball. He uses his favorite foot to get under the ball. He then swings his foot forward, connecting the top or instep of his foot with the underside of the ball. This procedure is continually repeated until the aspiring player begins to feel natural about the sensation of the ball touching the top of his foot.

After repeated kicking of the ball in this position while standing still, the aspiring soccer player then takes a couple of steps back, and takes a few running steps forward, planting his pivot or nonkicking foot next to the ball and driving his kicking foot under the ball and through the entire length of the channel created by the side support members. This teaches the aspiring soccer player to "follow through."

If the soccer player were to just punch the ball, which is a natural tendency, this would leave the kicking foot standing inside the device between the upstanding side support members. In order to accomplish the correct kick and not leave his kicking foot inside the device, he must force his foot all the way through the length of the device as part of the kicking motion.

The guiding groove 43, which runs down the center of base plate 21, forces the aspiring soccer player to concentrate and guide his kicking foot along the groove. Following the groove causes the foot to impact the ball 49 along its center, and thereby perform a well-executed kick.

Different trajectories of the ball can be obtained simply by moving the ball to a different position with respect to the pivot foot. At position 16, the ball will have a higher trajectory than at position 14. At position 18 of the upper height level, an even higher trajectory of the ball is obtained. Both these positions are practiced by the young player as follows. He places his nonkicking foot at position 14 next to the kick trainer 11. When a round of stationary kicks have been accomplished proficiently, the young player then runs up to the device, places his nonkicking or pivot foot at position 14 next to the device 11 and kicks through the channel of the two side support members, connecting the ball with the top or instep of his foot. This causes the ball, at position 16, to leave at a higher trajectory than when in position 14, and at an even higher trajectory when in position 18. This procedure teaches the aspiring soccer player that the trajectory achievable on the ball is determined by the point of impact of the kicking foot with the ball and the trajectory of the foot.

When the training soccer player is proficient at the higher beginning level, by performing to the satisfaction of the coaching staff, the two top side support members 13 and 17 are removed. When only using the two bottom side support members 15 and 19, the ball is approximately 1 to ½ inch off the ground. This causes the aspiring soccer player to point his kicking toe more towards the ground in order for the instep of his foot to come in contact with the ball. At this level, the entire procedure set forth above is repeated. When the aspiring soccer player achieves proficiency at the lower height, or advanced level, the soccer kick-training device is removed and the ball is placed on the ground for repetition of the drills described above.

The soccer kick-trainer and the drills which are to be utilized with it teaches the aspiring soccer player to use the "instep" or "top of the shoe kick," while at the same time teaching him to follow through on the kick and, most important, causing him to focus on the ball while kicking. Without focus, instead of kicking the ball, the player is more likely to kick the kick-trainer. The kick-trainer also causes the aspiring soccer player to learn what it feels like to kick a ball that is in the air, as well as on the ground. All these kicks are "instep" kicks.

The ramp area 22 at the front of the kick-trainer is utilized to prevent an errant kick which comes in too low to kick the training apparatus out from under the ball. This would occur without the runway or ramp. With the ramp in place, if the kick is too low, it guides the foot to the ball.

The kick-trainer described herein can be used to teach a variety of kicks utilized in the soccer game besides kicks to move a ball down a field. The soccer kick-trainer of the present invention can teach angle kicks, which are used for "corner kicks," penalty kicks, and goal kicks.

The entire procedure described herein can be utilized to train both feet, starting with the beginning level and working down to the advanced level, for each foot of the soccer player. Not only is the favored kicking foot trained and its abilities enhanced, but the nonfavored foot can be trained to the same level as the favored foot, thereby providing a soccer player that can maneuver the soccer ball with either foot with equal capacity.

I claim:

1. A soccer ball kick-training device, comprising:

a base for placement in the ground, said base being of predetermined length and width and relatively thin, said base having a plurality of holes therein along its length at a first and second side;

a first wall of predetermined height and length removably attachable to said base having at least one dowel extending from an edge designed to mate with a hole along said first side; and a second wall of predetermined height and length removably attachable to said base having at least one dowel extending form an edge designed to mate with a hole along said second side;

whereby a soccer ball is supported between said first and second walls so that a kicking foot will move between said first and second walls during the kicking process.

2. The soccer ball kick-training device of claim 1 wherein said base includes a ramp at one end thereof.

3. The soccer ball kick-training device of claim 1 wherein said base includes a hand-held aperture therein at one end thereof.

4. The soccer ball kick-training device of claim 1 wherein said first and second walls include a plurality of paired arcuate cutouts one on each wall along the top edges of said first and second wall, whereby each pair of arcuate cutouts define a ball placement location.

5. The soccer ball kick-training device of claim 4 wherein said base includes a hand-held aperture therein at one end thereof.

6. The soccer ball kick-training device of claim 1 wherein said base extends beyond said length of said first and second walls, said extended portions being shaped in a ramp from ground level.

7. The soccer ball kick-training device of claim 1 further comprising:

a third wall of predetermined height and length aligned with and being supported by said first wall; and a fourth wall of predetermined height and length aligned with and being supported by said second wall.

8. The soccer ball kick-training device of claim 7 wherein said first and second wall have a plurality of holes therein along their length on the upper edge thereof;

said third wall includes at least one dowel extending from an edge and designed to mate with a hole in the upper edge of the first wall; and said fourth wall includes at least one dowel extending from an edge and designed to mate with a hole in the upper edge of the second wall.

9. The soccer ball kick-training device of claim 8 wherein said third and fourth wall includes a plurality of paired arcuate cutouts, one on each wall, along the top edge of said third and fourth wall, whereby each pair of arcuate cutouts define a ball placement location.

10. The soccer ball kick-training device of claim 9 wherein said base extends beyond said length of said walls, said extended portion being shaped in a ramp from the ground level.

11. The soccer ball kick-training device of claim 8 wherein said base includes a hand-held aperture therein at one end thereof.

* * * * *